US012478154B2

(12) United States Patent
Scicluna

(10) Patent No.: US 12,478,154 B2
(45) Date of Patent: Nov. 25, 2025

(54) EXPANDABLE LUGGAGE

(71) Applicant: TUMI, INC., Edison, NJ (US)

(72) Inventor: Paul V. Scicluna, Delanco, NJ (US)

(73) Assignee: TUMI, INC., Edison, NJ (US)

( * ) Notice: Subject to any disclaimer, the term of this patent is extended or adjusted under 35 U.S.C. 154(b) by 118 days.

(21) Appl. No.: 18/022,049

(22) PCT Filed: Aug. 19, 2020

(86) PCT No.: PCT/US2020/047053
§ 371 (c)(1),
(2) Date: Feb. 17, 2023

(87) PCT Pub. No.: WO2022/039738
PCT Pub. Date: Feb. 24, 2022

(65) Prior Publication Data

US 2023/0346092 A1 Nov. 2, 2023

(51) Int. Cl.
*A45C 7/00* (2006.01)
*A45C 5/03* (2006.01)

(52) U.S. Cl.
CPC ..... *A45C 7/0022* (2013.01); *A45C 2005/037* (2013.01)

(58) Field of Classification Search
CPC ..... A45C 7/0022; A45C 2005/037
See application file for complete search history.

(56) References Cited

U.S. PATENT DOCUMENTS 248,486 A * 10/1881 McGuire ..... A45C 5/02 190/28
2,785,795 A * 3/1957 Ryno ..... B65D 81/07 206/466
3,088,623 A * 5/1963 Parker ..... E05C 19/14 292/113

(Continued)

FOREIGN PATENT DOCUMENTS

CN 203388397 U 1/2014
CN 104287380 A 1/2015

(Continued)

OTHER PUBLICATIONS

International Search Report and Written Opinion for PCT/US2020/047053 dated Jun. 15, 2021.

*Primary Examiner* — Tri M Mai
(74) *Attorney, Agent, or Firm* — Lando & Anastasi, LLP

(57) ABSTRACT

An expandable frame (15, 115) for a carrying article is disclosed. A frame (15) for an expandable article of luggage (10) includes a first frame member (16) including a first recess (54), a second frame member (16) including a second recess (64), and a gusset (22) extending between the first frame member (16) and the second frame member (18) to secure the first frame member (16) to the second frame member (18). A first edge (40) of the gusset (22) is received in the first recess (54) in the first frame member, and a second edge (60) of the gusset (22) is received in the second recess (64) in the second frame member (18). An article of luggage (10) including the expandable frame (15) is disclosed. In some embodiments, an expandable frame (115) does not include the first frame member and the gusset (122) is secured directly to a first hard shell (112) of an article of hard shell luggage (110).

22 Claims, 12 Drawing Sheets

(56) References Cited

U.S. PATENT DOCUMENTS

| | | | | |
|---|---|---|---|---|
| 3,497,041 | A | 2/1970 | Samhammer | |
| 3,523,596 | A * | 8/1970 | Dyke | A45C 7/0022 190/103 |
| 4,953,673 | A * | 9/1990 | Ambasz | A45C 7/0022 190/103 |
| 6,220,411 | B1 * | 4/2001 | Scicluna | A45C 7/0031 190/103 |
| 7,735,615 | B2 * | 6/2010 | Looram | A45C 13/103 383/97 |
| 9,826,808 | B2 * | 11/2017 | Yeh | A45C 5/02 |
| 2006/0011437 | A1 | 1/2006 | Selvi | |

FOREIGN PATENT DOCUMENTS

| | | | |
|---|---|---|---|
| CN | 105476231 | A | 4/2016 |
| DE | 2031472 | A1 | 1/1972 |
| EP | 2826393 | A1 | 1/2015 |
| EP | 3106053 | A1 | 12/2016 |
| JP | S4944626 | B1 | 11/1974 |
| JP | 2017006609 | A | 1/2017 |
| JP | 2019209112 | A | 12/2019 |
| WO | 2005000067 | A1 | 1/2005 |
| WO | 2018068342 | A1 | 4/2018 |

* cited by examiner

EXPANDABLE LUGGAGE

FIELD OF THE INVENTION

The present disclosure is related to carrying articles such as articles of luggage, and more particularly expandable hard side luggage cases which include frames, having an expandable compartment for carrying items therein. In particular, the present disclosure is related expandable frames for hard-shell luggage and to hard-shell luggage having an expandable frame.

BACKGROUND

Luggage and other carrying articles are often expandable to allow a user to store a greater volume of items in one or more internal compartments of the luggage. Documents that may be related to the present disclosure include:

WO 2006/039725 discloses a method and system for compressing and automatically expanding an expandable luggage case comprising a ratchet mechanism and a bungee cord, that is used to bias a locking mechanism, in the form of detents that mate with teeth, in a locked position, and to bias a jack mechanism for automatic expansion. The bungee cord biases the ratchet compressor system in an expanded state. Thus, automatic expansion is achieved. In addition to being operated while the luggage case is open, the ratchet compressor is also operable from the outside of the luggage case once the luggage case has been packed and closed.

U.S. Pat. No. 7,281,616 discloses an item of expandable luggage that includes a substantially rigid main peripheral frame and a substantially rigid secondary peripheral frame. A peripherally continuous gusset of flexible material is connected between the two peripheral frames. Opposite wall panels of the main peripheral frame are joined to corresponding opposite wall panels of the secondary peripheral frame by bridge assemblies, one such assembly being associated with each of the opposite wall panels of the respective frames. Each bridge assembly includes a receiving member affixed to the wall panel of the first component, the receiving member having an aperture therein, and a substantially rigid bridge plate affixed to the wall panel of the second component and slidably received by the receiving members, the plate having a first and second tongue capable of cooperating with the aperture.

U.S. Pat. No. 9,560,902 discloses an article of luggage that includes a luggage main body having a bottom surface and a cavity formed to receive articles for packing; an expansion body having a perimeter defining a cavity; a foldable gusset joining the luggage main body to the expansion body; and an expansion and locking device disposed internally at opposite ends of the article of luggage. The expansion and locking device is a ratcheting device.

SUMMARY OF THE INVENTION

Aspects and embodiments are directed to an improved carrying article, for example a luggage article, in particular an expandable hardside luggage article which has a frame. In some embodiments, the frame is configured for attachment to a gusset that in combination with the frame provides a contracted position and an expanded position of the frame to provide an expandable frame assembly. In some embodiments, the expandable frame assembly further includes a bracing mechanism that locks the frame in multiple positions including the contracted position and the expanded position. In some embodiments, the bracing mechanism is a sliding bracing mechanism. In some embodiments, the sliding bracing mechanism includes a tongue and groove assembly. In some embodiments, the expandable frame is part of an article of luggage. In some embodiments, the expandable frame is part of a hard-shell luggage article. In some embodiments, the hard-shell of the hard shell luggage includes metal. In some embodiments, the hard-shell includes aluminum.

Other aspects and embodiments are directed to an improved carrying article, such as an article of luggage having an improved frame. In some embodiments, the improved frame is configured for attachment to a gusset that in combination with the frame provides an expandable frame assembly that includes a contracted position and an expanded position of the article of luggage. In some embodiments, the article of luggage includes a bracing mechanism that locks the expandable frame in the contracted position and the expanded position. In some embodiments, the bracing mechanism is a sliding bracing mechanism. In some embodiments, the sliding bracing mechanism includes a tongue and groove assembly. In some embodiments, the article of luggage is a hard-shell luggage. In some embodiments, the hard-shell includes metal. In some embodiments, the hard-shell includes aluminum.

According to an aspect of the present disclosure, an expandable hardshell luggage article comprises a first hard shell, a frame member, and a gusset secured to the first hard shell and the frame member. The gusset extends between the first hard shell and the frame member to secure the first hard shell to the frame member.

In some embodiments, the gusset is secured directly to the first hard shell.

In some embodiments, the gusset is secured to the first hard shell with an adhesive and the gusset is secured to the frame member with an adhesive.

In some embodiments, the frame member is a second frame member and the expandable hardshell luggage article further comprises a first frame member secured to the first hard shell. The gusset is secured to the first frame member so that the first frame member secures the gusset to the first hard shell.

In some embodiments, the first frame member includes a first recess and the second frame member includes a second recess, a first edge of the gusset is received in the first recess in the first frame member, and a second edge of the gusset is received in the second recess in the second frame member.

In some embodiments, the first edge of the gusset is wrapped at least partially around a first rod, and the first edge of the gusset and the first rod are received in the first recess.

In some embodiments, the second edge of the gusset is wrapped at least partially around a second rod, and the second edge of the gusset and the second rod are received in the second recess.

In some embodiments, the expandable hardshell luggage article further comprises a first insert and the first edge of the gusset and the first rod are frictionally received in the first insert that is frictionally received in the first recess.

In some embodiments, the expandable hardshell luggage article further comprises a second insert and the second edge of the gusset and the second rod are frictionally received in the second insert that is frictionally received in the second recess.

In some embodiments, the first insert has a c-shaped cross section and the second insert has a c-shaped cross section.

In some embodiments, the expandable hardshell luggage article further comprises a third frame member secured to a second hard shell.

In some embodiments, the third frame member is secured to the second frame member by at least one hinge.

In some embodiments, the first frame member is secured to the first hard shell by a first plurality of rivets and the third frame member is secured to the second hard shell by a second plurality of rivets.

In some embodiments, the gusset is made of a material comprising a flexible material and or a fabric.

In some embodiments, the gusset is made of a fabric, preferably comprising at least one of nylon and polyester.

In some embodiments, the gusset is made of a material comprising at least one of nylon and polyester.

In some embodiments, the first hard shell is made of a material comprising at least one of metal and plastic.

In some embodiments, the first hard shell and the second hard shell are made of aluminum.

In some embodiments, the first frame member is movably secured to the second frame member by a bracing mechanism that in a first position holds the second frame member in secure engagement against the first frame member such that the second frame member is adjacent the first frame member, and in a second position secures the second frame member in spaced apart relation with respect to the first frame member.

In some embodiments, the first frame member and the second frame member have a tongue and groove engagement.

In some embodiments, the second frame member and the third frame member are secured together by at least one locking closure.

In some embodiments, each locking closure is a latch.

According to another aspect of the present disclosure, a frame for an expandable hardshell luggage article comprises a first frame member, a second frame member, and a gusset having a first edge secured to the first frame member and a second edge secured to the second frame member. The gusset extends between the first frame member and the second frame member to secure the first frame member to the second frame member.

In some embodiments, a first edge of the gusset is received in the first recess in the first frame member, and a second edge of the gusset is received in the second recess in the second frame member.

In some embodiments, the first edge of the gusset is wrapped at least partially around a first rod, and the first edge of the gusset and the first rod are received in the first recess.

In some embodiments, the second edge of the gusset is wrapped at least partially around a second rod, and the second edge of the gusset and the second rod are received in the second recess.

In some embodiments, the frame further comprises a first insert and the first edge of the gusset and the first rod are frictionally received in the first insert that is frictionally received in the first recess.

In some embodiments, the frame further comprises a second insert and the second edge of the gusset and the second rod are frictionally received in the second insert that is frictionally received in the second recess.

In some embodiments, the first insert has a c-shaped cross section and the second insert has a c-shaped cross section.

In some embodiments, the frame further comprises a third frame member. The third frame member is secured to the second frame member by a hinge.

In some embodiments, the gusset is made of a material comprising a flexible material and or a fabric.

In some embodiments, the gusset is made of a fabric, preferably comprising at least one of nylon and polyester.

In some embodiments, the gusset is made of a material comprising at least one of nylon and polyester.

In some embodiments, the first frame member is movably secured to the second frame member by a bracing mechanism that in a first position holds the second frame member in secure engagement against the first frame member such that the second frame member is adjacent the first frame member, and in a second position secures the second frame member in spaced apart relation with respect to the first frame member.

In some embodiments, the first frame member and the second frame member have a tongue and groove engagement.

According to another aspect of the present disclosure, an expandable hardshell luggage article comprises a first hard shell, a frame member, a gusset securing the first hard shell to the frame member, and a bracing mechanism that in a first position holds the frame member at a first distance from the first hard shell, and in a second position secures the frame member at a second distance from the first hard shell.

In some embodiments, the gusset is secured directly to the first hard shell.

In some embodiments, the gusset is secured to the first hard shell with an adhesive and the gusset is secured to the frame member with an adhesive.

In some embodiments, the frame member is a second frame member and the expandable hardshell luggage article further comprises a first frame member that is secured to the first hard shell. The gusset extends between the first frame member and the second frame member to secure the second frame member to the first frame member. The second frame member is held in secure engagement against the first frame member when the bracing mechanism is in the first position such that the second frame member is adjacent the first frame member. The second frame member is in spaced apart relation with respect to the first frame member when the bracing mechanism is in the second position.

In some embodiments, the first frame member includes a first recess and the second frame member includes a second recess, a first edge of the gusset is received in the first recess in the first frame member, and a second edge of the gusset is received in the second recess in the second frame member.

In some embodiments, the first edge of the gusset is wrapped at least partially around a first rod, and the first edge of the gusset and the first rod are received in the first recess.

In some embodiments, the second edge of the gusset is wrapped at least partially around a second rod, and the second edge of the gusset and the second rod are received in the second recess.

In some embodiments, the expandable hardshell luggage article of claim further comprises a first insert. The first edge of the gusset and the first rod are frictionally received in the first insert that is frictionally received in the first recess.

In some embodiments, the expandable hardshell luggage article further comprises a second insert. The second edge of the gusset and the second rod are frictionally received in the second insert that is frictionally received in the second recess.

In some embodiments, the first insert has a c-shaped cross section and the second insert has a c-shaped cross section In some embodiments, the expandable hardshell luggage article further comprises a third frame member secured to a second hard shell. The third frame member is connected to the second frame member.

In some embodiments, the first frame member is secured to the first hard shell by a first plurality of rivets and the third frame member is secured to the second hard shell by a second plurality of rivets.

In some embodiments, the third frame member is secured to the second frame member by a hinge.

In some embodiments, the gusset is made of a material comprising a flexible material and or a fabric.

In some embodiments, the gusset is made of a fabric, preferably comprising at least one of nylon and polyester.

In some embodiments, the gusset is made of a material comprising at least one of nylon and polyester.

In some embodiments, the first hard shell and the second hard shell are made of a material comprising at least one of metal and plastic.

In some embodiments, the first hard shell and the second hard shell are made of aluminum.

In some embodiments, the second frame member and the first frame member have a tongue and groove engagement.

In some embodiments, the bracing mechanism in the first position holds the second frame member in secure engagement against the first hard shell such that the second frame member is adjacent the first hard shell, and in a second position secures the second frame member in spaced apart relation with respect to the first hard shell.

According to another aspect of the present disclosure, an expandable hardshell luggage article comprises a first hard shell, a frame member; and a gusset secured to the first hard shell and the frame member, the gusset extending between the first hard shell and the frame member to secure the first hard shell to the frame member.

In some embodiments, the gusset is secured directly to the first hard shell.

In some embodiments, the gusset is secured to the first hard shell with an adhesive and the gusset is secured to the frame member with an adhesive.

In some embodiments, wherein the frame member is a second frame member and the expandable hardshell luggage article further comprises a first frame member secured to the first hard shell. The gusset is secured to the first frame member so that the first frame member secures the gusset to the first hard shell.

In some embodiments, the first frame member includes a first recess and the second frame member includes a second recess, a first edge of the gusset is received in the first recess in the first frame member, and a second edge of the gusset is received in the second recess in the second frame member.

In some embodiments, the first edge of the gusset is wrapped at least partially around a first rod, and the first edge of the gusset and the first rod are received in the first recess.

In some embodiments, the second edge of the gusset is wrapped at least partially around a second rod, and the second edge of the gusset and the second rod are received in the second recess.

In some embodiments, the expandable hardshell luggage article further comprises a first insert and wherein the first edge of the gusset and the first rod are frictionally received in the first insert that is frictionally received in the first recess.

In some embodiments, the expandable luggage further article further comprises a second insert and wherein the second edge of the gusset and the second rod are frictionally received in the second insert that is frictionally received in the second recess.

In some embodiments, the first insert has a c-shaped cross section and the second insert has a c-shaped cross section.

In some embodiments, the expandable luggage further article further comprises a third frame member secured to a second hard shell.

In some embodiments, the third frame member is secured to the second frame member by at least one hinge.

In some embodiments, the first frame member is secured to the first hard shell by a first plurality of rivets and wherein the third frame member is secured to the second hard shell by a second plurality of rivets.

In some embodiments, the gusset is made of a material comprising a flexible material and or a fabric.

In some embodiments, the gusset is made of a fabric, preferably comprising at least one of nylon and polyester.

In some embodiments, the gusset is made of a material comprising at least one of nylon and polyester.

In some embodiments, the first hard shell is made of a material comprising at least one of metal and plastic.

In some embodiments, the first hard shell is made of aluminum.

In some embodiments, the first frame member is movably secured to the second frame member by a bracing mechanism that in a first position holds the second frame member in secure engagement against the first frame member such that the second frame member is adjacent the first frame member, and in a second position secures the second frame member in spaced apart relation with respect to the first frame member.

In some embodiments, the first frame member and the second frame member have a tongue and groove engagement.

According to another aspect of the present disclosure, an expandable luggage further article comprises a first hard shell, a first frame member secured to the first hard shell, a second frame member, and a gusset secured to the first frame member and the second frame member. The gusset extends between the first frame member and the second frame member to secure the first frame member to the second frame member.

In some embodiments, the first frame member includes a first recess and the second frame member includes a second recess. A first edge of the gusset is received in the first recess in the first frame member, and a second edge of the gusset is received in the second recess in the second frame member.

In some embodiments, the first edge of the gusset is wrapped at least partially around a first rod, and the first edge of the gusset and the first rod are received in the first recess.

In some embodiments, the second edge of the gusset is wrapped at least partially around a second rod, and the second edge of the gusset and the second rod are received in the second recess.

In some embodiments, the expandable luggage further article comprises a first insert and the first edge of the gusset and the first rod are frictionally received in the first insert that is frictionally received in the first recess.

In some embodiments, the expandable luggage further article comprises a second insert and the second edge of the gusset and the second rod are frictionally received in the second insert that is frictionally received in the second recess.

In some embodiments, the first insert has a c-shaped cross section. In some embodiments, the second insert has a c-shaped cross section.

In some embodiments, the expandable luggage further article further comprises a third frame member secured to a second hard shell. In some embodiments, the third frame member is secured to the second frame member by at least one hinge.

In some embodiments, the first frame member is secured to the first hard shell by a first plurality of rivets. In some embodiments the third frame member is secured to the second hard shell by a second plurality of rivets.

In some embodiments, the gusset is made of a material comprising a flexible material and or a fabric.

In some embodiments, the gusset is made of a fabric, preferably comprising at least one of nylon and polyester.

In some embodiments, the gusset is made of a material comprising at least one of nylon and polyester.

In some embodiments, the first hard shell is made of a material comprising at least one of metal and plastic. In some embodiments, the second hard shell is made of a material comprising at least one of metal and plastic.

In some embodiments, the first hard shell is made of aluminum. In some embodiments, the second hard shell is made of aluminum.

In some embodiments, the first frame member is movably secured to the second frame member by a bracing mechanism that in a first position holds the second frame member in secure engagement against the first frame member such that the second frame member is adjacent the first frame member, and in a second position secures the second frame member in spaced apart relation with respect to the first frame member.

In some embodiments, the first frame member and the second frame member have a tongue and groove engagement.

According to an aspect of the present disclosure, a frame for an expandable luggage further article comprises a first frame member including a first recess; a second frame member including a second recess; and a gusset extending between the first frame member and the second frame member to secure the first frame member to the second frame member. A first edge of the gusset is received in the first recess in the first frame member, and a second edge of the gusset is received in the second recess in the second frame member.

In some embodiments, the first edge of the gusset is wrapped at least partially around a first rod, and the first edge of the gusset and the first rod are received in the first recess.

In some embodiments, the second edge of the gusset is wrapped at least partially around a second rod, and the second edge of the gusset and the second rod are received in the second recess.

In some embodiments, the frame comprises a first insert. In some embodiments, the first edge of the gusset and the first rod are frictionally received in the first insert that is frictionally received in the first recess.

In some embodiments, the frame comprises a second insert. In some embodiments, the second edge of the gusset and the second rod are frictionally received in the second insert that is frictionally received in the second recess.

In some embodiments, the first insert has a c-shaped cross section. In some embodiments the second insert has a c-shaped cross section.

In some embodiments, the frame further comprises a third frame member. In some embodiments, the third frame member is secured to the second frame member by a hinge.

In some embodiments, the gusset is made of a material comprising a flexible material and or a fabric.

In some embodiments, the gusset is made of a fabric, preferably comprising at least one of nylon and polyester.

In some embodiments, the gusset is made of a material comprising at least one of nylon and polyester.

In some embodiments, the first frame member is movably secured to the second frame member by a bracing mechanism that in a first position holds the second frame member in secure engagement against the first frame member such that the second frame member is adjacent the first frame member, and in a second position secures the second frame member in spaced apart relation with respect to the first frame member.

In some embodiments, the first frame member and the second frame member have a tongue and groove engagement.

According to an aspect of the present disclosure, an expandable luggage further article comprises a first hard shell; a frame member; a gusset securing the first hard shell to the frame member; and a bracing mechanism that in a first position holds the frame member at a first distance from the first hard shell, and in a second position secures the frame member at a second distance from the first hard shell.

In some embodiments, the expandable luggage further article further comprises a first hard shell frame member that is secured to the first hard shell. In some embodiments, the gusset extends between the first hard shell frame member and the frame member to secure the first hard shell frame member to the frame member. The frame member is held in secure engagement against the first hard shell frame member when the bracing mechanism is in the first position such that the frame member is adjacent the first hard shell frame member, and the frame member being secured in spaced apart relation with respect to the first hard shell frame member when the bracing mechanism is in the second position.

In some embodiments, the first hard shell frame member includes a first recess and the frame member includes a second recess. In some embodiments a first edge of the gusset is received in the first recess in the first hard shell frame member. In some embodiments, a second edge of the gusset is received in the second recess in the frame member.

In some embodiments, the first edge of the gusset is wrapped at least partially around a first rod, and the first edge of the gusset and the first rod are received in the first recess.

In some embodiments, the second edge of the gusset is wrapped at least partially around a second rod, and the second edge of the gusset and the second rod are received in the second recess.

In some embodiments, the expandable luggage further article comprises a first insert and the first edge of the gusset and the first rod are frictionally received in the first insert that is frictionally received in the first recess.

In some embodiments, the expandable luggage further article comprises a second insert and the second edge of the gusset and the second rod are frictionally received in the second insert that is frictionally received in the second recess.

In some embodiments, the first insert has a c-shaped cross section. In some embodiments, the second insert has a c-shaped cross section.

In some embodiments, the expandable luggage further article further comprises a second hard shell frame member secured to a second hard shell. In some embodiments, the second hard shell frame member is connected to the frame member.

In some embodiments, the first hard shell frame member is secured to the first hard shell by a first plurality of rivets. In some embodiments, the second hard shell frame member is secured to the second hard shell by a second plurality of rivets.

In some embodiments, the second hard shell frame member is secured to the frame member by a hinge.

In some embodiments, the gusset is made of a material comprising a flexible material and or a fabric.

In some embodiments, the gusset is made of a fabric, preferably comprising at least one of nylon and polyester.

In some embodiments, the gusset is made of a material comprising at least one of nylon and polyester.

In some embodiments, the first hard shell is made of a material comprising at least one of metal and plastic. In some embodiments, the second hard shell is made of a material comprising at least one of metal and plastic.

In some embodiments, the first hard shell is made of aluminum. In some embodiments, the second hard shell is made of aluminum.

In some embodiments, the first hard shell frame member and the frame member having a tongue and groove engagement.

According to an aspect of the disclosure, an expandable luggage further article comprises a first hard shell, a first frame member that is secured to the first hard shell, a second frame member, a gusset securing the first hard shell to the second frame member, and a bracing mechanism. The gusset extends between the second frame member and the first frame member to secure the first frame member to the second frame member. The bracing mechanism in a first position holds the second frame member at a first distance from the first frame member and the first hard shell, and in a second position secures the second frame member at a second distance from the first frame member and the first hard shell. In the first position of the bracing mechanism the second frame member is adjacent the first frame member. In the second position of the bracing mechanism, the second frame member is in spaced apart relation with respect to the first frame member.

In some embodiments, the second frame member includes a second recess, the first frame member includes a first recess, a first edge of the gusset is received in the first recess in the first frame member, and a second edge of the gusset is received in the second recess in the second frame member.

In some embodiments, the first edge of the gusset is wrapped at least partially around a first rod, and the first edge of the gusset and the first rod are received in the first recess. In some embodiments, the second edge of the gusset is wrapped at least partially around a second rod, and the second edge of the gusset and the second rod are received in the second recess.

In some embodiments, the hard shell luggage further comprises a first insert, wherein the first edge of the gusset and the first rod are frictionally received in the first insert that is frictionally received in the first recess. In some embodiments, the hard shell luggage further comprises a second insert, wherein the second edge of the gusset and the second rod are frictionally received in the second insert that is frictionally received in the second recess.

In some embodiments, the first insert has a c-shaped cross section and the second insert has a c-shaped cross section.

In some embodiments, hard shell further comprises a third frame member, and the third frame member is secured to the second frame member by at least one hinge. In some embodiments, the second frame member and the third frame member are secured together by a locking closure.

It is appreciated that any of the features of any of the embodiments can be used with any of the aspects and embodiments disclosed herein and it is understood that they can so be combined in any manner.

BRIEF DESCRIPTION OF THE DRAWINGS

Various aspects of at least one embodiment are discussed below with reference to the accompanying figures. The figures are provided for the purposes of illustration and explanation and are not intended as a definition of the limits of the invention. In the figures.

LIST OF REFERENCE NUMERALS UTILIZED IN THE DRAWINGS

Figure 1:
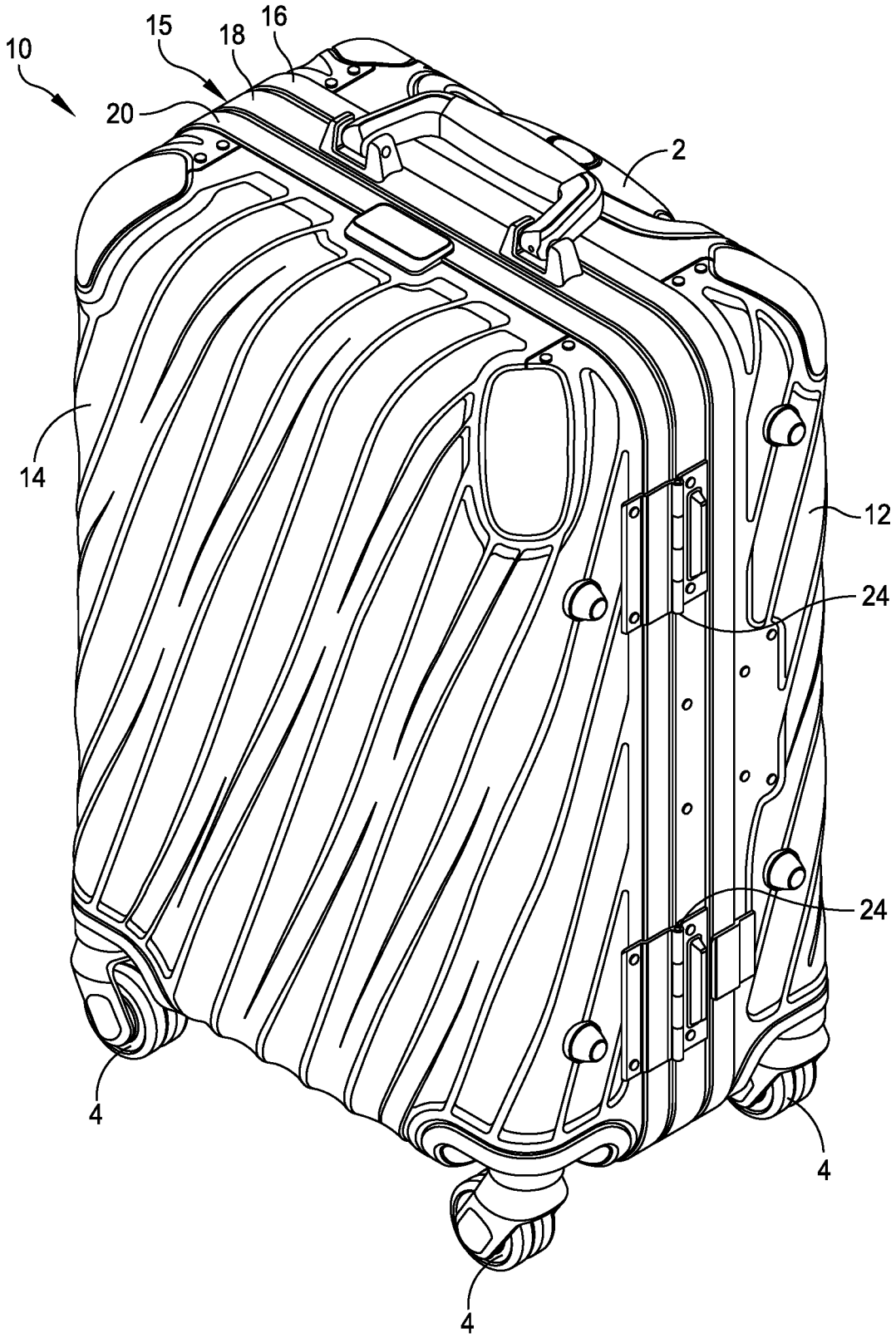
FIG. 1 is a front perspective view of an exemplary embodiment of an article of luggage according to the present disclosure, with the article of luggage in a contracted condition.

With regard to reference numerals used, the following numbering is used throughout the description and drawings. Where technical features in the figures or detailed description are followed by these reference numerals, the reference numerals have been included for the sole purpose of increasing the intelligibility of the figures or detailed description. Accordingly, neither the reference numerals nor their absence is intended to have any limiting effect on the scope of any claim elements. In the figures, each identical or nearly identical component that is illustrated in various figures is represented by a like numeral. For purposes of clarity, not every component may be labeled in every figure.

Reference numeral 2 refers to a tow handle;

Reference numeral 4 refers to a wheel;

Reference numeral 10 refers to an article of luggage;

Reference numeral 12 refers to a first hard shell;

Reference numeral 14 refers to a second hard shell;

Reference numeral 15 refers to a frame assembly;

Reference numeral 16 refers to a first frame member;

Reference numeral 18 refers to a second frame member;

Reference numeral 20 refers to a third frame member;

Reference numeral 22 refers to a gusset;
Reference numeral 23 refers to a stiffener;
Reference numeral 24 refers to hinges;
Reference numeral 25 refers to locking closures;
Reference numeral 26 refers to a tongue of a frame member;
Reference numeral 28 refers to a groove of a frame member;
Reference numeral 30 refers to a tongue of a frame member;
Reference numeral 32 refers to a groove of a frame member;
Reference numeral 36 refers to a first face of the gusset;
Reference numeral 38 refers to a second face of the gusset;
Reference numeral 40 refers to a first edge of the gusset;
Reference numeral 46 refers to a line of stitching;
Reference numeral 48 refers to a line of stitching;
Reference numeral 50 refers to a first rod;
Reference numeral 50A refers to a first rod segment;
Reference numeral 50B refers to a second rod segment;
Reference numeral 50C refers to a third rod segment;
Reference numeral 50D refers to a fourth rod segment;
Reference numeral 54 refers to a first recess in the first frame member
Reference numeral 56 refers to a first insert;
Reference numeral 60 refers to a second edge of the gusset;
Reference numeral 62 refers to a second rod;
Reference numeral 62A refers to a first rod segment;
Reference numeral 62B refers to a second rod segment;
Reference numeral 62C refers to a third rod segment;
Reference numeral 62D refers to a fourth rod segment;
Reference numeral 64 refers to a second recess in the second frame member;
Reference numeral 66 refers to a second insert;
Reference numeral 70A refers to a first bracing mechanism;
Reference numeral 70B refers to a second bracing mechanism;
Reference numeral 72 refers to a tongue portion;
Reference numeral 74 refers to a slot in the tongue portion;
Reference numeral 76 refers to a base;
Reference numeral 78 refers to a spring biased latch;
Reference numeral 80 refers to an opening in the tongue portion;
Reference numeral 82 refers to a latching surface;
Reference numeral 84 refers to an internal liner of a main compartment of the article of luggage;
Reference numeral 110 refers to an article of luggage;
Reference numeral 112 refers to a first hard shell;
Reference numeral 114 refers to and a second hard shell;
Reference numeral 115 refers to a frame assembly;
Reference numeral 118 refers to a first frame member;
Reference numeral 120 refers to a second frame member;
Reference numeral 122 refers to a gusset;
Reference numeral 136 refers to a first face of the gusset;
Reference numeral 138 refers to a second face of the gusset;
Reference numeral 140 refers to a first edge of the gusset; and
Reference numeral 142 refers to a second edge of the gusset.

DETAILED DESCRIPTION

Aspects and embodiments are directed to an improved carrying article, for example a luggage article, in particular an expandable hardside luggage article which has a frame. In some embodiments, the frame is configured for attachment to a gusset that in combination with the frame provides an expandable frame assembly having a contracted position and an expanded position of the expandable frame assembly. In some embodiments, the expandable frame assembly further includes a bracing mechanism that locks the frame assembly in the contracted position and the expanded position. In some embodiments, the bracing mechanism is a sliding bracing mechanism. In some embodiments, the sliding bracing mechanism includes a tongue and groove assembly. In some embodiments, the expandable frame assembly is configured for use with an article of luggage. In some embodiments, the expandable frame assembly is used with a hard-shell article of luggage. In some embodiments, the hard-shell of the hard-shell article of luggage includes metal. In some embodiments, the hard-shell includes aluminum.

Other aspects and embodiments are directed to an improved carrying article, such as an article of luggage having an improved frame. In some embodiments, the improved frame is attached to a gusset that in combination with the frame provides an expandable frame assembly having a contracted position and an expanded position of the article of luggage. In some embodiments, the article of luggage includes a bracing mechanism that locks the frame in the contracted position and the expanded position. In some embodiments, the bracing mechanism is a sliding bracing mechanism. In some embodiments, the sliding bracing mechanism includes a tongue and groove assembly. In some embodiments, the article of luggage is a hard-shell article of luggage. In some embodiments, a hard-shell of the hard-shell article of luggage includes metal. In some embodiments, the hard-shell includes aluminum.

As used herein, "hard shell luggage" refers to luggage that includes at least one hard shell. Each hard shell of the hard shell luggage is sufficiently rigid that it retains a shape that defines an outer surface of the luggage and resists deformation under external loading. For example, other articles of luggage can be stacked on an upper surface of the hard shell luggage or another surface of the hard shell luggage, without transmitting force to internal contents within a compartment of the luggage. In preferred embodiments, the hard shell can be made of metal, such as aluminum. However, it is appreciated that any material typically used in a hard shell as known to one of skill in the art can be used. The term "hard shell" as used herein luggage is used in contrast with soft shell luggage as known to those of skill in the art. For example, soft shell luggage may be made of materials such as fabric nylon, ballistic nylon, and/or other flexible materials. Soft shell luggage articles include main compartments having different closure mechanisms than the hard shell luggage articles of the present disclosure. For example, a soft shell luggage article may include a main compartment having a zipper closure, a button closure, or another similar flexible closure. In contrast, hard shell luggage of the present disclosure includes a compartment that is accessible through a hinged closure that can be held closed by latches. In some embodiments, the hinged closure includes two frame members that are secured together on one side by at least one hinge and secured together on an opposite side by at least one latch.

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as may be included within the spirit and scope of the described embodiments as disclosed. It is appreciated that any of the features of any of the embodiments can be used with any of the aspects and embodiments and it is understood that they can so be combined in any manner. Nothing herein should be construed to require any feature to be restricted to any combination of features.

As disclosed herein, the expandable frame assembly for hard shell luggage provides various advantages over existing frame assemblies for hard shell luggage. The expandable frame assembly allows a hard shell compartment of hard-shell luggage to be movable between a contracted configuration and an expanded configuration of the hard-shell luggage compartment. The expandable frame assembly also allows two hard shell compartments to be movable with respect to each other between the expanded configuration and the contracted configuration. In the expanded configuration, the hard shell compartment can be secured in a plurality of positions relative to a frame of the expandable frame assembly by one or more bracing mechanisms so that the hard shells are secured in a plurality of positions relative to each other. In some embodiments, the one or more bracing mechanisms enable a user to secure one hard shell in a fixed spatial relation with respect to the frame and both hard shells to be in fixed spatial relation in the plurality of positions relative to each other.

Turning now to FIG. 1, an article of luggage, generally indicated at 10 is illustrated in a contracted condition. The article of luggage includes a first hard shell 12 and a second hard shell 14. The article of luggage 10 is shown in an upright configuration in FIG. 1 in which a tow handle 2 is located at an upper end of the luggage 10 and four wheels 4 are located at a lower end of the luggage. To open the luggage 10, a user can rotate the article of luggage 90 degrees so that the rear face of the first hard shell 12 is on a support surface, such as a floor or a piece of furniture, and the second hard shell 14 is located above the first hard shell 12.

Figure 2A:
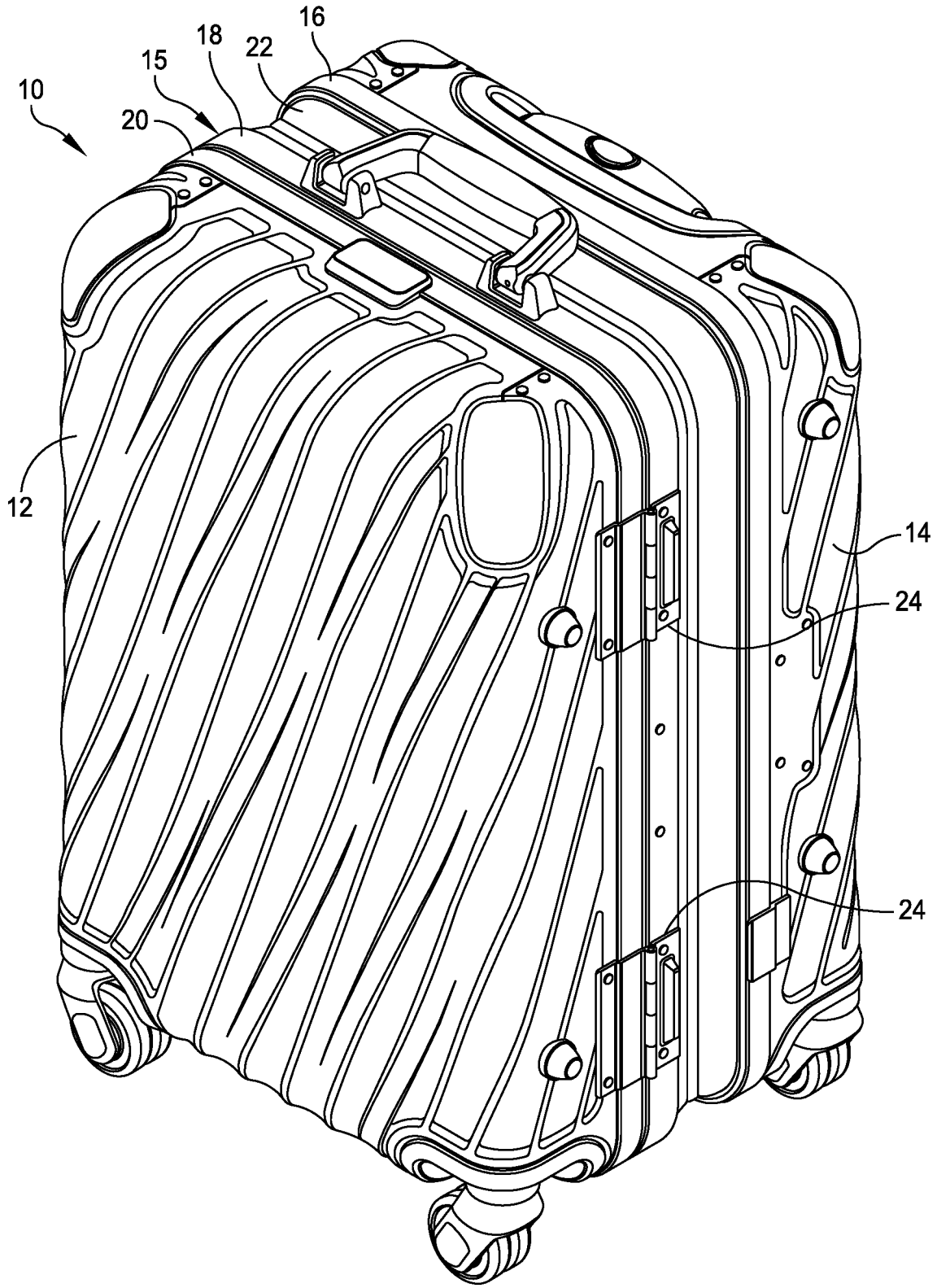
FIG. 2A is a front perspective view of the article of luggage of FIG. 1 in an expanded condition.

The first hard shell 12 is secured to the second hard shell 14 by a frame assembly indicated generally at 15. The frame assembly 15 includes a first frame member 16, a second frame member 18, and a third frame member 20. The first frame member 16 is secured to the first shell 12. The first frame member 16 extends around the perimeter of the edge of the first shell 12. In some embodiments, the first frame member 16 is secured to the first shell 12 by a plurality of rivets (not illustrated). The second frame member 18 extends about the perimeter of the luggage 10, adjacent to the first frame member 16. The second frame member 18 is secured to the first frame member 16 by a gusset 22 and two sliding bracing mechanisms 70A, 70B, which are described in more detail below. The second frame member 18 may be referred to as a floating frame member, because it may be held in secure adjacent relation against the first frame member 16 when the luggage 10 is in the contracted configuration of FIG. 1 by the bracing mechanisms, or held in an expanded position away from the first frame member 16 by the bracing mechanisms when the article of luggage 10 is in the expanded configuration, as illustrated in FIG. 2A. The third frame member 20 is secured to the second shell 14. The third frame member 20 extends around the perimeter of the open edge of the second shell 14. In FIG. 1, the third frame member 20 is secured to the second shell 14 by a plurality of rivets (not illustrated). The second frame member 18 is secured to the third frame member 18 by two locking closures 25 and by hinges 24.

Figure 2B:
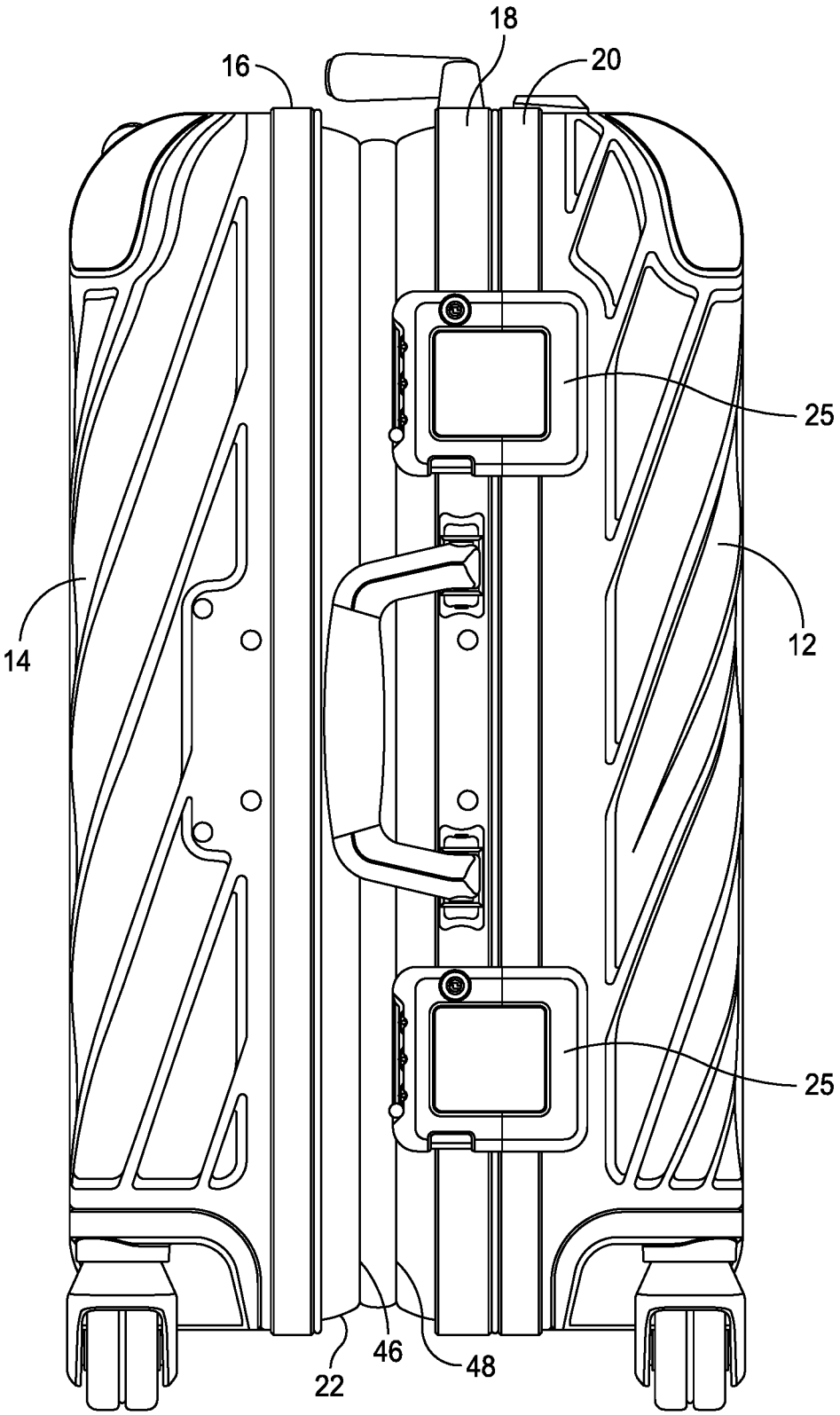
FIG. 2B is a left side elevational view of the article of luggage of FIG. 1 in an expanded condition.

The second frame member 18 is connected by at least one hinge 24 to the third frame member 20 so that the second frame member and the third frame member define a central opening of the article of luggage. In the embodiment of FIG. 1 and FIGS. 2A, 2B, the second frame member 18 is illustrated as connected by two hinges 24 to the third frame member 20. Each hinge 24 attaches the second frame member 18 to the third frame member 20. According to aspect and embodiments, each hinge 24 does not connect to the first frame member 16. Thus, the second frame member and the third frame member are held in secure engagement with each other by two locking closures 25 and hinges 24. When the locking closures 25 are in an unlocked position, second frame member 18 rotates about the hinge 24 relative to the third frame member 20, the first frame member 16 rotates with the second frame member 18.

In some embodiments, each hinge 24 is secured to the second frame member 18 and the third frame member 20 by rivets.

Each hard shell 12, 14 is made of a material that protects objects within the luggage 10. In some embodiments, the first hard shell 12 and/or the second hard shell 14 comprises metal. In some embodiments, the first hard shell 12 and/or the second hard shell 14 is made of one or more materials comprising aluminum. In some embodiments, the first hard shell 12 and/or the second hard shell 14 is made of one or more materials comprising plastic. In some embodiments, the first hard shell 12 is a rear hard shell of the article of luggage, and the second hard shell 14 is a front hard shell of the article of luggage.

FIG. 2A illustrates the article of luggage with one of the compartments in an expanded condition. The compartment of the article of luggage can be moved between the contracted condition of FIG. 1 and the expanded condition of FIG. 2A by moving the frame member 16 relative to the frame member 18 so as to move second hard shell 14 of the luggage with respect to the frame member 18 and with respect to the first hard shell 12. The frame members 16, 18 are moved with respect to each other to control expansion and contraction of the luggage compartment or opening of the luggage, as described in more detail below.

With reference to FIG. 2B, it is illustrated that the main compartment of the luggage is closed, with the second frame member 18 and the third frame member 20 held in secure engagement with each other by the two locking closures 25 and hinges 24. In FIG. 2B, the locking closures 25 are latches. With this arrangement, the second frame member 18 is engaged with the third frame member 20 to close the compartment and to seal a periphery of the compartment of the luggage in the closed condition.

According to aspects and embodiments, each of the first frame member 16, the second frame member 18, and the third frame member is made of one or more materials used to form the first shell and/or second shell. In some embodiments, each of the first frame member 16, the second frame member 18, and the third frame member is made of one or more materials comprising aluminum. In some embodiments, each of the first frame member 16, the second frame member 18, and the third frame member is made of one or more materials comprising plastic.

According to aspects and embodiments, each of the first frame member 16, the second frame member 18, and the third frame member 20 may be covered in fabric. In some embodiments, the frame members 16, 18, 20 are covered by a woven fabric.

According to aspects and embodiments of the disclosure, a flexible, compressible material may be placed between the first frame member 16, which is attached to the second shell 14 and the second frame member 18. According to aspects and embodiments, in a contracted position of the main compartment, the first frame member of the second shell 14 is adjacent the second frame member 18 so that the first frame member 16 and second frame member 18 are adjacent to compress the compressible material and in an expanded position of the main compartment, the first frame member of the second shell 14 and the second frame member 18 are spaced apart and connected by the compressible material in the expanded position. According to aspects and embodiments, the flexible, compressible material can be attached to the first frame member 16 and the second frame member 18 by any mechanism known to one of skill in the art. For example, according to one embodiment, a first edge 40 of the compressible material can be attached to first frame member 16 and a second edge 60 of the compressible material can be attached to the second frame member 18 by an adhesive.

Figure 3:
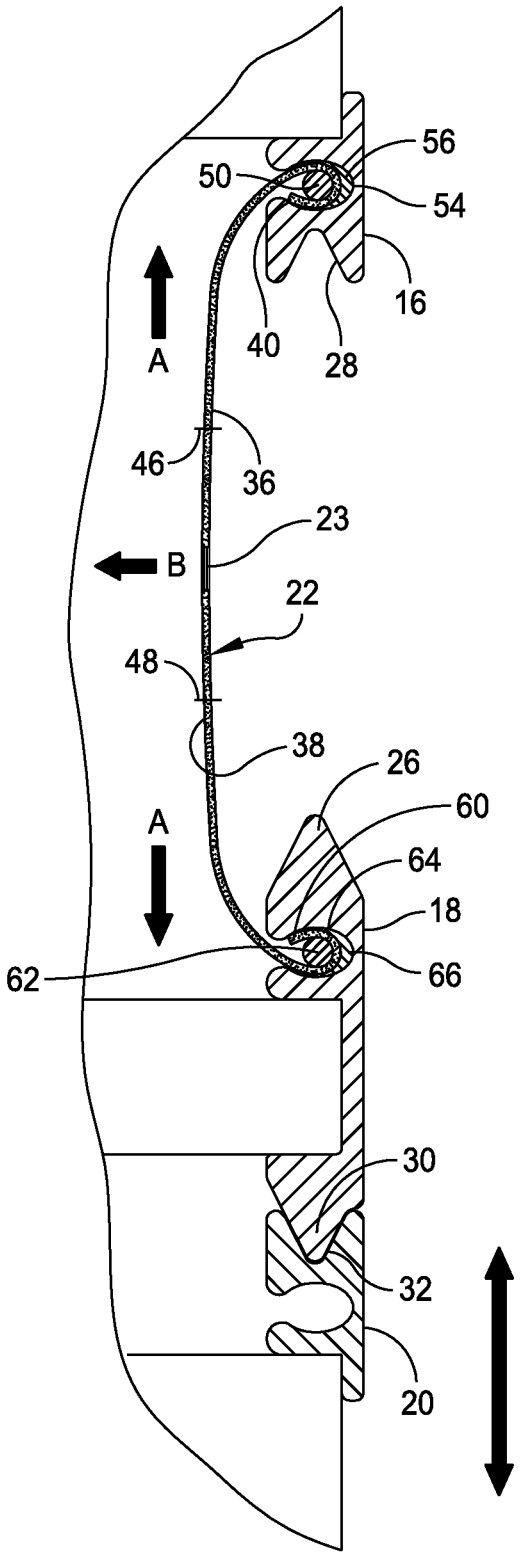
FIG. 3 is a cross-sectional view of the article of luggage of FIG. 2A in the expanded condition.

Referring to FIG. 3, there is illustrated an embodiment of a frame assembly that includes a tongue and groove engagement between the adjacent frame members 16, 18 and 20. The tongue and groove arrangement provides for the frame members firmly engage each other. As illustrated in FIG. 3, the first frame member 16 has a groove 28 and the second frame member 18 has a tongue 26 to provide a mating tongue and groove arrangement between the first and second frame assemblies. In addition, the second frame member 18 includes a tongue 30 and the third frame member 20 includes a groove 32 to also have a mating tongue and groove arrangement between the second frame assembly and the third frame assembly.

In some embodiments, a flexible, compressible material may be placed between the adjacent frame members 16,18 so that the adjacent frame members 16, 18 compress the compressible material when the tongue 26 of one frame member 18 is received in the groove 28 of an adjacent frame member 16. In some embodiments, the compressible material includes a gusset positioned between adjacent frame members. In some embodiments, the compressible material includes a rubber tubing positioned between adjacent frame members.

FIG. 3 also illustrates the flexible material herein also referred to as a gusset, indicated generally at 22, that extends between the first frame member 16 and the second frame member 18. The gusset 22 is made of a flexible material. As noted above, the gusset 22 can be secured to the first frame member 16 and the second frame member 18 by any means known to one of skill in the art, including an adhesive, or other means as disclosed herein, so as to provide a barrier that retains contents in the interior of the main compartment of luggage 10 when the luggage 10 is the expanded configuration, as illustrated in FIGS. 2A, 2B, and 3. The arrows A in FIG. 3 show the direction in which a user has moved the first frame member 16 and the second frame member 18 to position the first frame member 16 and the second frame member 18 in the expanded configuration of FIG. 3.

The gusset 22 is made of a flexible material that allows the first frame member 16 to move with respect to the second frame member 18 as the luggage is moved between the contracted condition and the expanded condition. In some embodiments, the gusset 22 comprises a fabric. In some embodiments, the gusset 22 comprises ballistic nylon. In some embodiments, the gusset 22 comprises polyester. In some embodiments, the gusset 22 is dyed. In some embodiments, the gusset 22 is made of ballistic nylon and/or polyester because those materials facilitate dyeing.

The gusset 22 may be formed as a continuous loop of material that has a first face 36 and a second face 38. When the luggage 10 is in the expanded condition, the first face 36 forms part of the outer surface of the luggage 10 and the second face 38 is oriented inwardly towards contents retained in the luggage 10. The gusset 22 has a first edge 40 that is secured to the first frame member 16 and a second edge 60 that can be secured to the second frame member 18 by any means known to one of skill in the art.

In some embodiments, to prevent the gusset 22 from becoming caught between the first frame member 16 and the second frame member 18, the gusset 22 is a fabric gusset that includes at least one line of stitching that helps the gusset fold inwards into the compartment of the luggage 10. In a preferred embodiment as shown in FIG. 2B, the gusset 22 includes two lines of stitching 46, 48 that extend along the gusset 22. Each line of stitching 46, 48 creates a shape memory in the gusset that encourages the gusset 22 to move inwardly into the compartment of the luggage. Due to the stitching lines of the gusset 22, the gusset 22 is inwardly biased along arrow B so that when the luggage is collapsed, the gusset 22 pulls itself inwardly into the compartment and away from the groove 28 of the first frame member 16 and away from the tongue 26 of the second frame member.

In other embodiments, a single line of stitching can be used instead. In such embodiments, the gusset 22 is stitched into an inwardly oriented V-shape, with the peak of the V-shape located in the compartment of the luggage.

In some embodiments, the gusset 22 includes a stiffener 23 to help hold the material of the gusset cleanly on the inside of the luggage when the luggage 10 is in the collapsed condition. The stiffener may be made of various materials. In some embodiments, the stiffener 23 is made of materials including polyethylene and/or polypropylene.

In some embodiments, to prevent the gusset 22 from becoming caught between the first frame member 16 and the second frame member 18, the gusset 22 includes an elastic member that extends through a central portion of the gusset 22 along the length of the gusset. In some embodiments, the elastic member extends through a channel defined along the length of the gusset. When the luggage 10 is in the expanded condition as shown in FIG. 3, the elastic member would be held in tension such that an inward force along arrow B tends to pull the gusset 22 inward. As a user collapses the luggage 10 from the expanded configuration to the contracted configuration, the inward force along arrow B tends to pull the gusset 22 inward, away from the groove 28 of the first frame member 16 and away from the tongue 26 of the second frame member.

As will be explained further, in some embodiments, the first edge 40 of gusset 22 is secured to a first rod 50 that is secured to the first frame member 16 and the second edge 60 of the gusset 22 is secured to a second rod 62 that is secured to the second frame member 18. In some embodiments, each edge of the gusset is wrapped around a respective rod 50, 62. In some embodiments, each edge of the fabric is held onto a respective rod by a friction fit with a c-shaped holder or insert 56, 66. The c-shaped holder or insert has a c-shaped cross section. The c-shaped holder or insert is secured by a friction fit in a recess 54, 64 in a respective frame member.

Figure 4A:
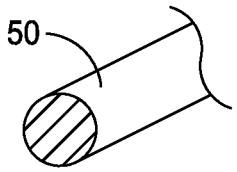
FIG. 4A is a sectional view of a rod of a frame member of the article of luggage of FIG. 1.
Figure 4B:
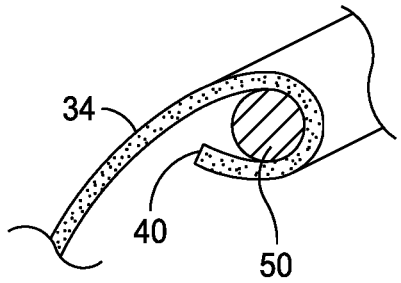
FIG. 4B is a sectional view of a step of securing a gusset to the rod of the article of luggage of FIG. 4A.
Figure 4C:
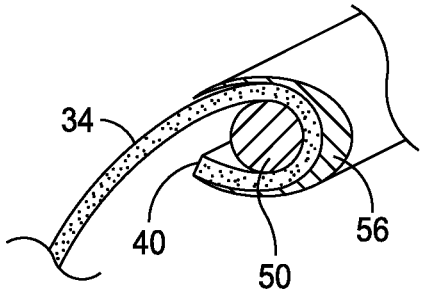
FIG. 4C is a sectional view of a step of securing the gusset and the rod of FIG. 4B to an insert.
Figure 4D:
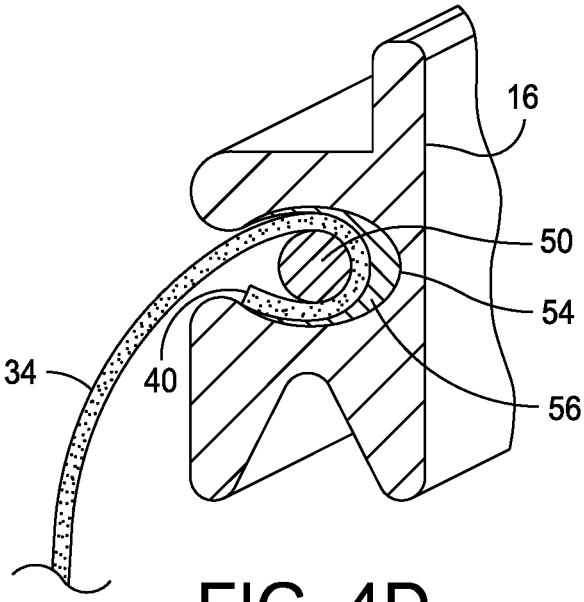
FIG. 4D is a sectional view of a step of securing the gusset, the rod and the insert of FIG. 4C to a frame member of the article of luggage of FIG. 1.

FIGS. 4A-4D illustrate steps in securing an edge 40 of the gusset 22 in the frame member 16 to arrive at the assembled structure of FIG. 3. FIG. 3 illustrates both edges 40, 60 of the gusset 22 secured to a respective frame member. FIG. 4A illustrates a rod 50 that is used for securing a first edge 40 of the gusset 22 to the first frame member 16. Referring to FIG. 4B, edge 40 of the gusset 22 is at least partially wrapped around a respective rod 50. In some embodiments, a first edge 40 of the gusset 22 is folded over first rod 50 and is secured in a first recess 54 in the first frame member 16, as illustrated in FIG. 4D. To frictionally secure the first rod 50 and the first edge 40 of the gusset 22 in the first recess 54, the first rod 50 and the gusset 22 are received in at least one first insert 56 as illustrated in FIG. 4C, that is received in the first recess 54 as illustrated in FIG. 4D. As illustrated in FIG. 4C, the first insert 56 has a c-shaped channel that receives the first rod 50 and edge 40 of the gusset 22 and applies pressure to the gusset 22 wrapped around the first rod 50.

Referring again to FIG. 3, a second edge 60 of the gusset 22 is folded over second rod 62 and is secured in a second recess 64 in the second frame member 18. To frictionally secure the second rod 62 and the gusset 22 in the second recess 64, the second rod 62 and the gusset 22 are received in at least one second insert 66 that is received in the second recess 64 of the frame member 18. Insert 66 has a c-shaped channel that receives the second rod 62 and gusset 22 and applies pressure to the gusset around the second rod 62. With this arrangement of the gusset, the rods, c-shaped inserts, and the recesses in the frames, the edges of the gusset 22 can be secured to the respective frame members 16, 18 so as to provide the sealed compartment having the expansion condition and contraction condition of the frames 16 and 18 and the shells 12, 14 with respect to each other.

Figure 4E:
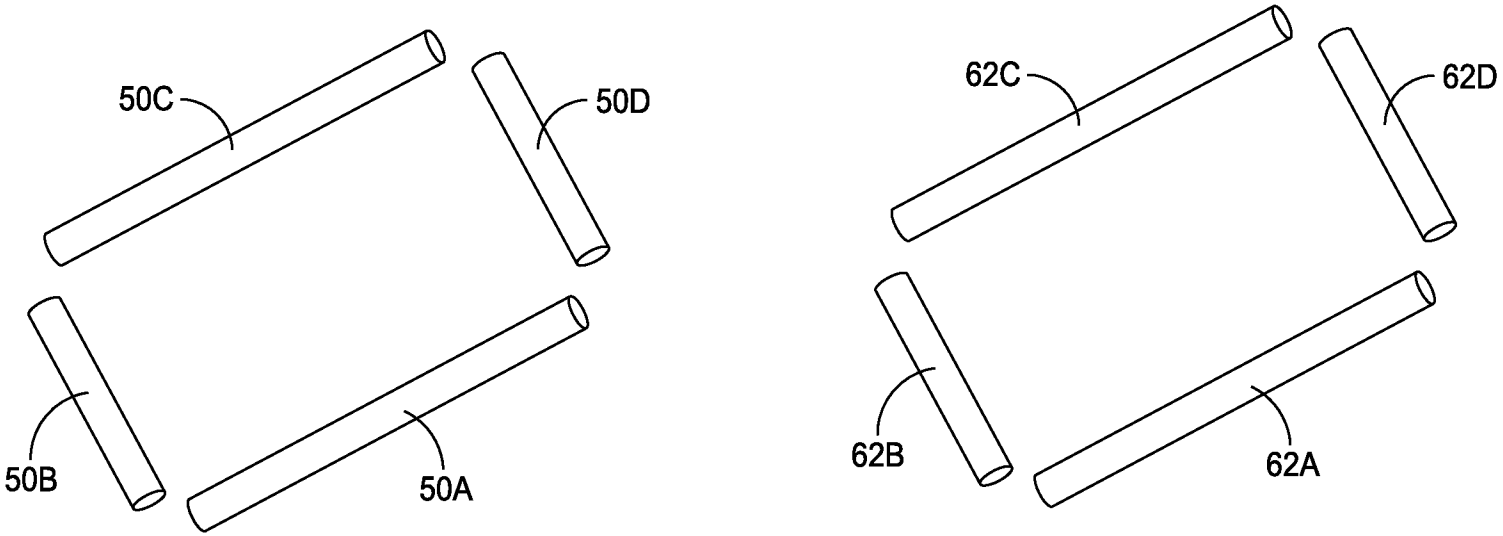
FIG. 4E is a schematic view of rod segments that can be used to secure the gusset to frame members.

In some embodiments, the first rod 50 includes at least four elongate rod segments, and the recess 54 is defined within four longitudinal portions of the first frame member 16. Each elongate rod segment of the first rod 50 is received in the recess 54 in a respective longitudinal portion of the first frame member 16. FIG. 4E shows four first rod segments 50A, 50B, 50C, 50D, which can each be received in a length of the recess 54 in a longitudinal portion of the first frame member 16 to secure the gusset 22 to the first frame member 16.

In some embodiments, the second rod 62 includes at least four elongate rod segments, and the recess 64 is defined within four longitudinal portions of the second frame member 18. Each elongate rod segment of the second rod 62 is received in the recess 64 in a respective longitudinal portion of the second frame member 18. FIG. 4E shows four first rod segments 62A, 62B, 62C, 62D, which can each be received in a length of the recess 64 in a longitudinal portion of the second frame member 18 to secure the gusset 22 to the first frame member 18.

Figure 10:
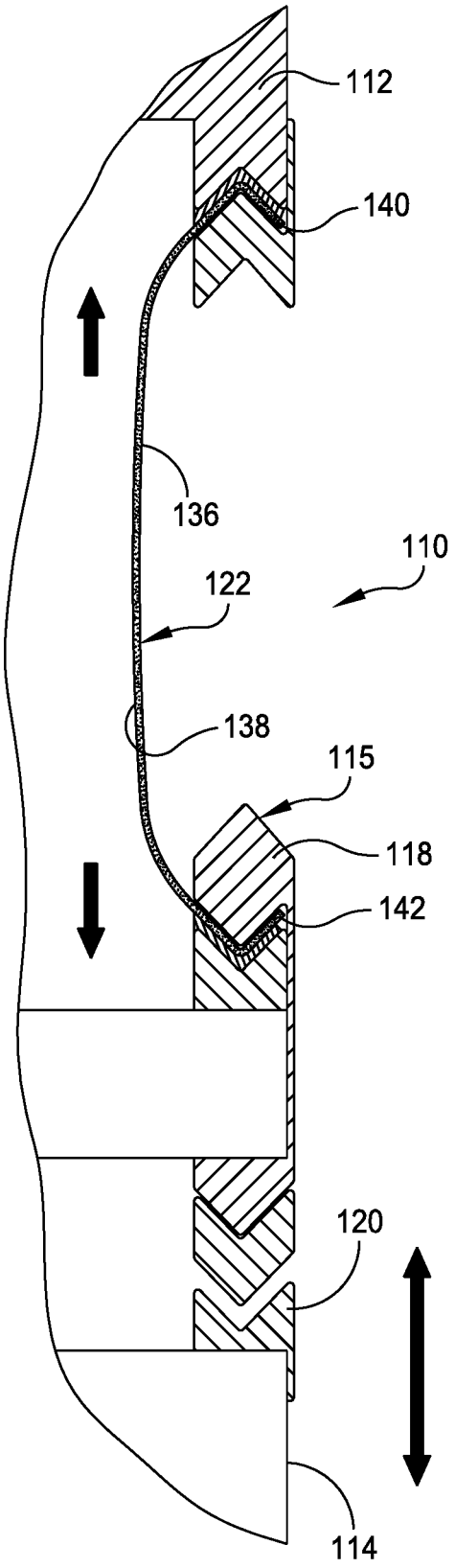
FIG. 10 is a sectional view of another embodiment of an article of luggage according to the present disclosure.

In some embodiments of framing assemblies according to the present disclosure, the c-shaped insert member is not included. For example, in some embodiments, at least one edge of the gusset is folded over a respective rod, and the rod is received in a respective recess defined in a respective frame member without the c-shaped member. In some embodiments, each edge of the gusset is folded over a respective rod, and each rod is received in a respective recess defined in a respective frame member. Another example of an embodiment of a framing assembly is shown in FIG. 10. In some embodiments, the frame assembly includes two frame members instead of the three frame members as shown for example in the embodiment of FIG. 1. For example, in some embodiments, the first frame member 16 of the embodiment of FIG. 1 is omitted, and the gusset is secured directly to the first shell.

FIG. 10 shows a cross-sectional view of a portion of an embodiment of an article of luggage 110 that includes a frame assembly having two frame members. In the embodiment of FIG. 10, the article of luggage 110 includes a first hard shell 112 and a second hard shell 114. The first hard shell 112 is secured to the second hard shell 114 by a frame assembly indicated generally at 115. The frame assembly 115 includes a first frame member 118 and a second frame member 120. The first frame member 118 extends about the perimeter of the luggage 110. The first frame member 118 is secured to the first hard shell 112 by a gusset 122 and two sliding locks. The sliding locks are similar to the sliding locks discussed herein in relation to other embodiments. The first frame member 118 may be referred to as a floating frame member, because it may be held in secure adjacent relation against the first shell 112 when the luggage 110 is in a contracted configuration, or held in an expanded position away from the first shell 112 when the article of luggage 110 is in an expanded configuration. The second frame member 120 is secured to the second shell 114. The second frame member 120 extends around the perimeter of the open edge of the second shell 114. In FIG. 10, the second frame member 120 is secured to the second shell 114 by a plurality of rivets (not illustrated).

The two frame members 118, 120 of the frame assembly 115 of FIG. 10 are referred to here as the first frame member 118 and the second frame member 120. The first frame member 118 serves similar purposes as the second frame member 20 in the above frame assembly 15 described above, and the second frame member 120 serves similar purposes as the third frame member 20 in the frame assembly 15 described above.

The gusset 122 may be formed as a continuous loop of material that has a first face 136 and a second face 138. When the luggage 110 is in the expanded condition, the first face 136 forms part of the outer surface of the luggage 110 and the second face 138 is oriented inwardly towards contents retained in the luggage 110. The gusset 122 has a first edge 140 that is secured to the first shell 112 and a second edge 142 that is secured to the first frame member 118. In some embodiments, the first edge 140 of the gusset is secured directly to the first shell 112 by a fastener and the second edge 142 of the gusset is secured directly to the first frame member 118 by a fastener. In some embodiments, the first edge 140 of the gusset is secured directly to the first shell 112 by an adhesive and the second edge 142 of the gusset is secured directly to the first frame member 118 by an adhesive.

The first frame member 118 is connected by at least one hinge to the second frame member 120 so that the first frame member and the second frame member define a central opening of the article of luggage 110. For example, in some embodiments the first frame member 118 is connected by two hinges to the second frame member 120.

According to aspects and embodiments, multiple rods may be used to secure the gusset 22 to a respective one of the frame members. For example, four rods may be used to secure the gusset to a respective one of the frame members, with each rod securing an edge of the gusset to one of four longitudinal regions of the respective frame member.

According to aspects and embodiments, the c-shaped insert is made of a material that is sufficiently rigid to retain the gusset and the rod in the recess, and is sufficiently resilient that it can be held in compression in the channel to provide a friction fit of the rods and gusset in the respective recess. In some embodiments, the c-shaped insert is made of plastic.

Figure 5:
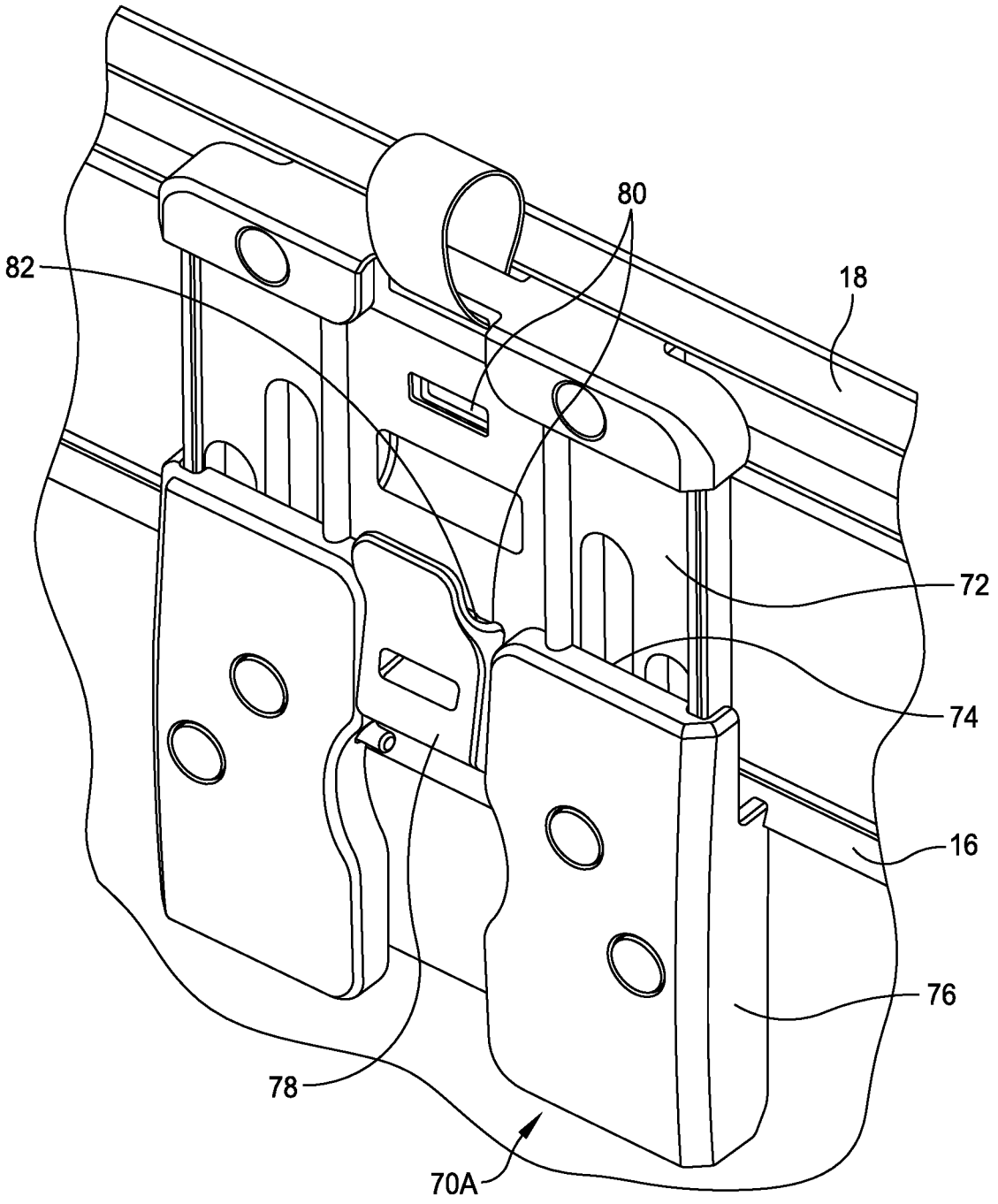
FIG. 5 is an upper perspective view of a bracing mechanism of the article of luggage of FIG. 1, with the bracing mechanism secured to a frame assembly and the with the bracing mechanism in an expanded condition.
Figure 6:
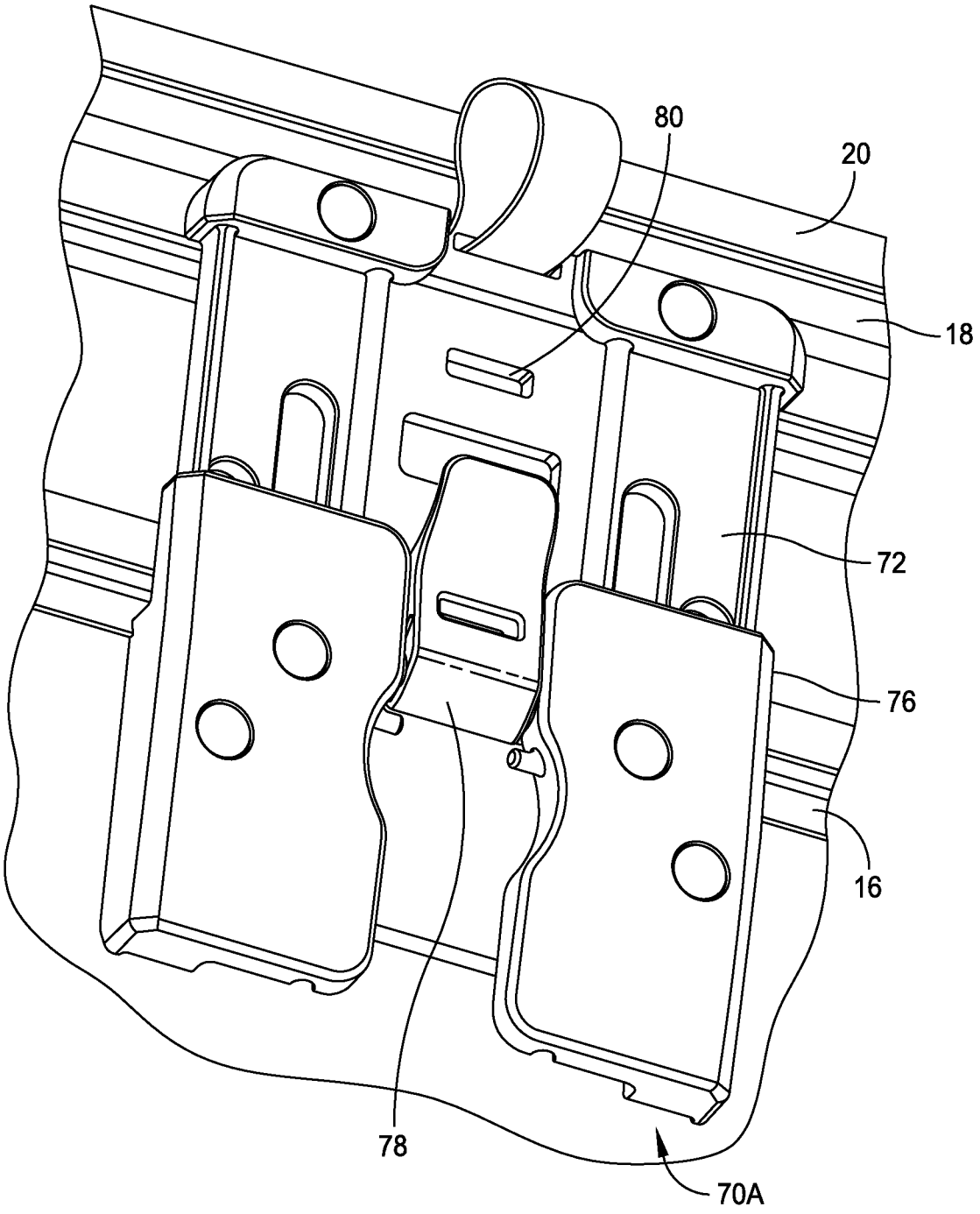
FIG. 6 is a lower perspective view of a bracing mechanism of the article of luggage of FIG. 1, with the bracing mechanism secured to a frame assembly and the with the bracing mechanism in an expanded condition.

Referring generally to FIGS. 5-6, at least one bracing mechanism 70A, 70B is provided to allow a user to move the shell 14 of the article of luggage 10 between the contracted condition and the expanded condition of the article of luggage 10 and to secure the shell 14 in a plurality of positions.

Figure 7:
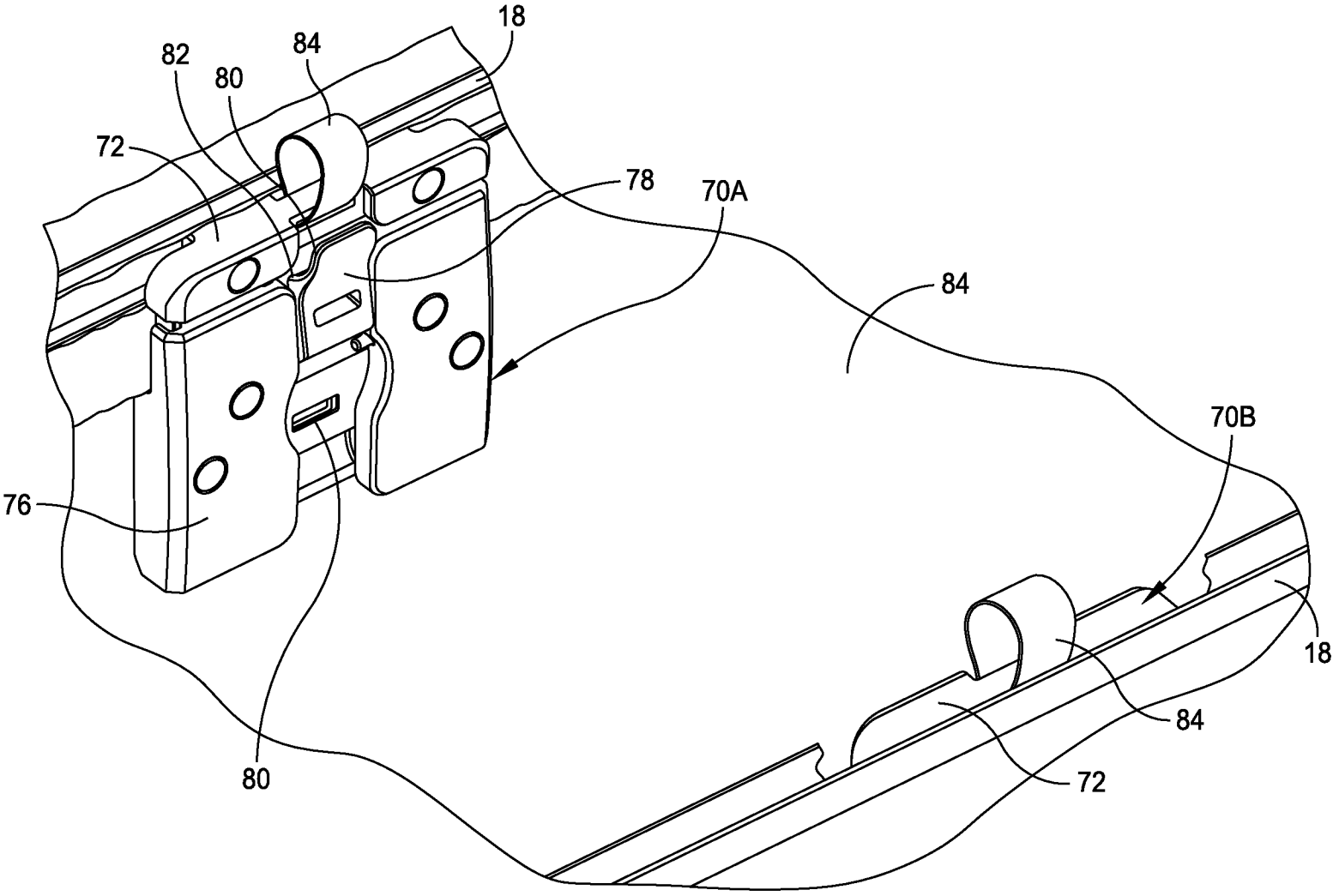
FIG. 7 is a perspective view of a bracing mechanism in a compartment of an embodiment of an article of luggage according to the present disclosure, with the bracing mechanism in a contracted condition.

FIG. 7 shows the article of luggage 10 when the main compartment is opened via the hinges 24. The main compartment includes a liner 84 that is secured to the first frame member 16. The article of luggage includes a first bracing mechanism 70A at one side of the main compartment and a second bracing mechanism 70B at an opposite side of the main compartment. In some embodiments, the bracing mechanisms are sliding locks. U.S. Pat. No. 8,479,900 discloses a bracket assembly for mounting to a piece of expandable luggage. U.S. Pat. No. 8,479,900 is incorporated herein by reference in its entirety. In some embodiments of a frame assembly and/or luggage according to the present disclosure, one or more of the bracing mechanisms is a bracket assembly that is disclosed in U.S. Pat. No. 8,479,900.

Each bracing mechanism 70A, 70B includes a tongue portion 72 that is received in a slot 74 defined in a base 76. Movement of the tongue 72 with respect to the base 76 is controlled by at least one spring biased latch 78. Each latch 78 is fixed to a respective base. Each latch 78 has a latching surface 82 that is configured to engage one of a plurality of openings 80 defined in the tongue 72. When the luggage 10 is in a contracted condition as illustrated in for example FIG. 7, the spring bias of the latch 78 causes the latching surface 82 to engage a first one of a plurality of openings 80 defined in the tongue. When the luggage 10 is in an expanded condition as illustrated in for example FIG. 5-6, the spring bias of the latch 78 causes the latching surface 82 to engage one of at least one of a second plurality of openings 80 defined in the tongue. With this arrangement, the first frame member 16 is movably secured to the second frame member 18 by at least one bracing mechanism 70A, 70B that in a first position holds the second frame member in secure engagement against the first frame member such that the second frame member is adjacent the first frame member, and in a second position secures the second frame member in spaced apart relation with respect to the first frame member.

Figure 8:
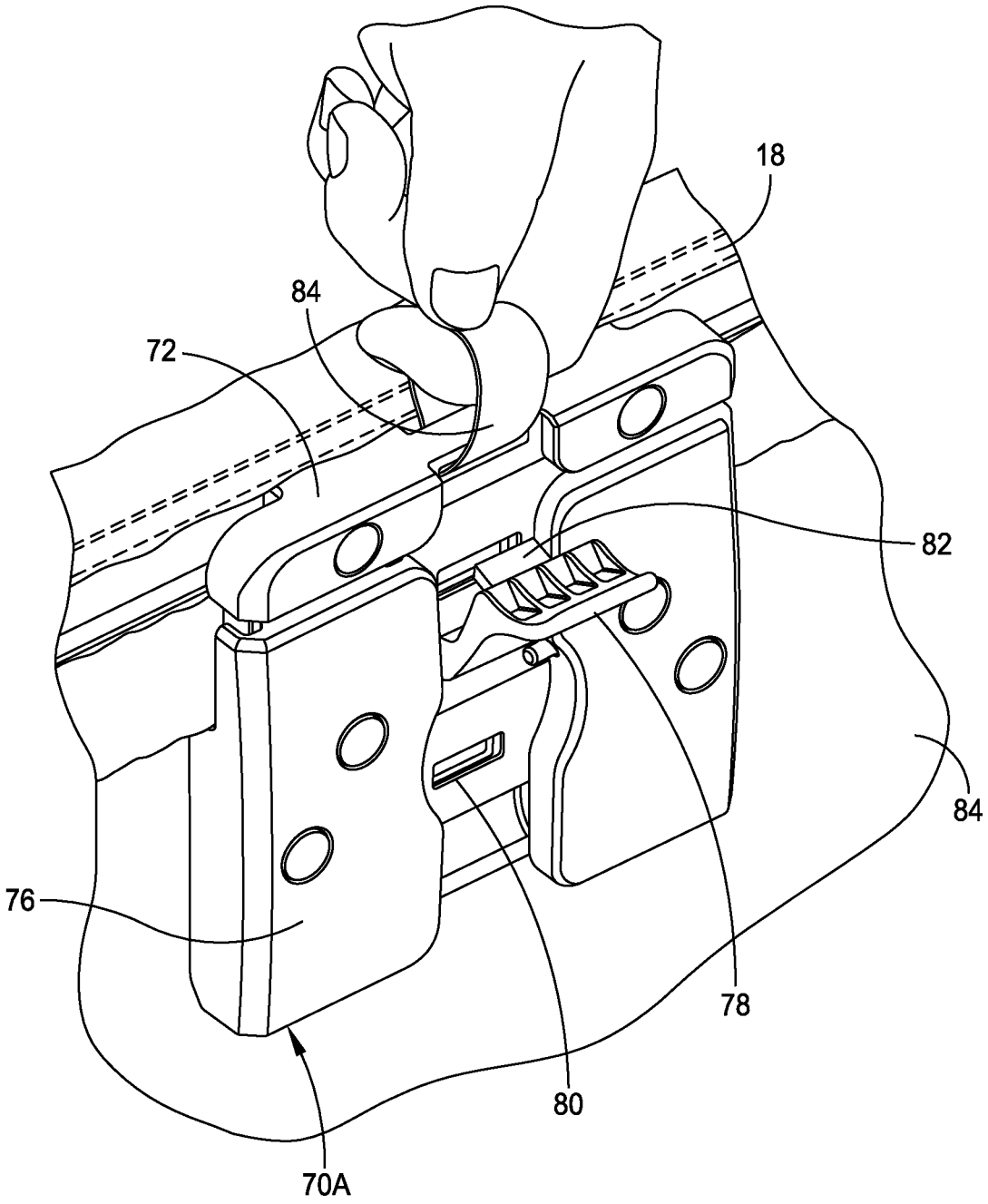
FIG. 8 is a perspective view of the bracing mechanism of FIG. 7 as a user pulls a tab on the bracing mechanism.
Figure 9:
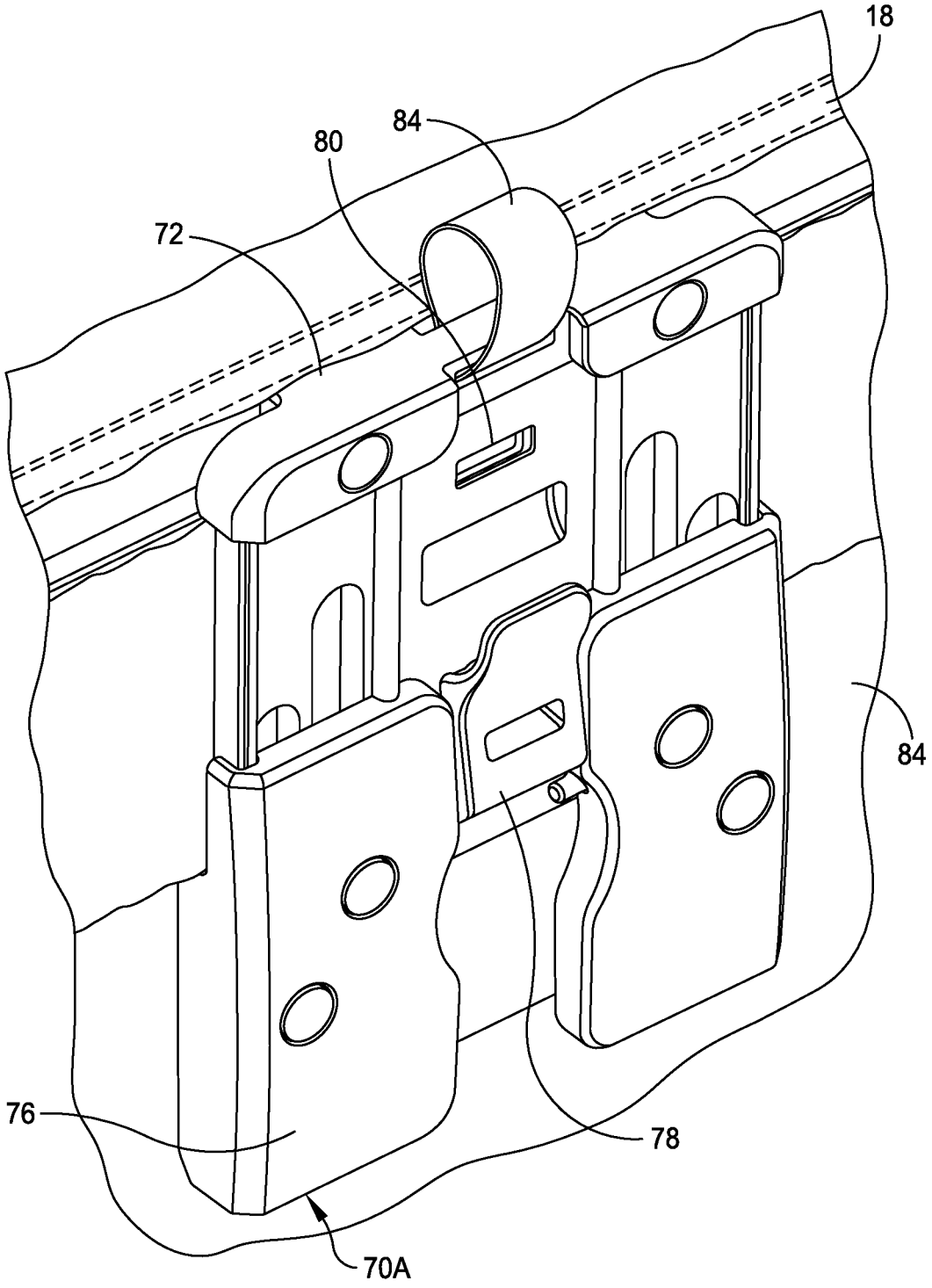
FIG. 9 is a perspective view of the bracing mechanism of FIG. 7 in an expanded condition.

According to at least one embodiment as illustrated for example in FIG. 5-6, the base 76 is secured to the first frame member 16 and the tongue 72 is secured to the second frame member 18. According to one embodiment, as illustrated in FIG. 7, the bracing mechanisms are secured to the frame members 16, 18 inside the hard-shell luggage compartments 12, 14 so that each latch is accessible from the inside of the luggage 10. Referring to FIGS. 7-9, there is illustrated movement of the luggage from the contracted condition to the expanded condition. When a user wishes to transition the luggage 10 from the contracted condition as illustrated in FIG. 7 to the expanded condition as illustrated in FIG. 9, the user rotates the latch 78 to disengage the first opening as illustrated in FIG. 8. Then the user pulls a strap 84 to slide the second frame member 18 with respect to the first frame member 16. The spring bias of the latch 78 causes the latching surface 82 to engage a second opening 80 defined in the tongue (See FIG. 6). It is appreciated that the tongue 72 can have plurality of openings 80 to provide for a plurality of expanded positions. To move the luggage back to the contracted condition, the user rotates the latch 78 to disengage the second opening in the tongue and the user slides the tongue 72 with respect to the base 76 to cause the second frame member 18 to be in direct engagement with and adjacent the first frame member 16. According to an aspect of the present disclosure, a frame assembly may include the first frame member, the second frame member, the gusset, the rods, the inserts, and the recesses in the respective frame members, and one or more sliding locks as described herein, without the first and second shells. The frame assembly may be subsequently used to form part of a hard shell luggage. According to an aspect of the disclosure, the frame assembly can be used to form part of an expandable and contractable soft shell article of luggage. According to aspects of the disclosure, the frame assembly can be used with various types, sizes and arrangement of luggage assemblies including, for example, carry on sized articles of luggage, luggage that is sized to be checked (not carried on), wheeled duffels, and various other size, arrangements and materials for the shells.

Advantages of an expandable and contractable hard shell luggage article of the present disclosure include the ability to expand a compartment of the hard shell luggage article to accommodate additional or larger items and to contract the compartment of the hard shell luggage article to be smaller in size. Another advantage is that the contractable hard shell luggage protects items contained within the luggage while in a contracted position and also while in an expanded condition. In addition, sliding locks secured to an expandable frame assembly of the hard shell luggage enable the expandable frame assembly of the hard shell luggage to provide stable support of the article of luggage. In addition, the expandable frame assembly provides stable support for additional items of luggage or other items that may be placed on an upper surface of the article of luggage, such as when a user is moving the luggage along a walkway.

Another advantage of the expandable frame assembly of the article of luggage is that the expandable hard-shell compartment of the hard shell luggage remains sealed in both the expanded position and the contracted position. In particular, the hard-shell compartment is sealed by a gusset. The gusset is secured about its perimeter to the frame of the luggage so that the gusset forms a barrier that seals the expandable hard-shell compartment of the luggage. The gusset is made of a flexible material that allows the gusset to be positioned within the main compartment of the luggage when the luggage is in a contracted condition and that allows the gusset to form a portion of an external surface of the luggage when the luggage is in an expanded condition.

While the disclosed subject matter is described herein in terms of certain exemplary embodiments, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other embodiments having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

What is claimed:

1. An expandable hardshell luggage article (10) comprising:

a first hard shell (12, 112);

a first frame member (18, 118) secured to the first hard shell;

a second frame member (18);

a gusset (22, 122) secured to the first frame member and the second frame member (18, 118), the gusset (22, 122) extending between the first hard shell (12, 112) and the second frame member (18, 118) to secure the first hard shell (12, 112) to the second frame member (18, 118);

wherein the first frame member (16) includes a first recess (54) and the second frame member (18) includes a second recess (64);

wherein a first edge (40) of the gusset (22) is received in the first recess (64) in the first frame member (16) and a second edge (60) of the gusset (22) is received in the second recess (64) in the second frame member (16);

wherein the first edge (40) of the gusset (22) is wrapped at least partially around a first rod (50) and the first edge (40) of the gusset (22) and the first rod (50) are received in the first recess (54);

wherein the second edge (60) of the gusset (22) is wrapped at least partially around a second rod (62) and the second edge (60) of the gusset (22) and the second rod (62) are received in the second recess (64); and further comprising a first insert (56), wherein the first edge (40) of the gusset (22) and the first rod (50) are frictionally received in the first insert (56) that is frictionally received in the first recess (54).

2. The expandable hardshell luggage article of claim 1, further comprising a third frame member (20, 120) secured to a second hard shell (14, 114).

3. The expandable hardshell luggage article of claim 2, wherein the third frame member (20, 120) is secured to the second frame member (18, 118) by at least one hinge (24).

4. The expandable hardshell luggage article of claim 1, wherein the gusset (22, 122) is made of a material comprising at least one of a flexible material and a fabric.

5. The expandable hardshell luggage article of claim 1, wherein the first hard shell (12) and the second hard shell (14) are made of aluminum.

6. The expandable hardshell luggage article of claim 1, wherein the first frame member (16) is movably secured to the second frame member (18) by a bracing mechanism (70A, 70B) that in a first position holds the second frame member (18) in secure engagement against the first frame member (16), and in a second position secures the second frame member (18) in spaced apart relation with respect to the first frame member (16).

7. The expandable hardshell luggage article of claim 6, wherein the first frame member (16) and the second frame member (18) have a tongue and groove engagement.

8. The expandable hardshell luggage article of claim 1, further comprising a second insert (66), wherein the second edge (60) of the gusset (22) and the second rod (62) are frictionally received in the second insert (66) that is frictionally received in the second recess (64).

9. The expandable hardshell luggage article of claim 8, wherein the first insert (56) has a c-shaped cross section and the second insert (66) has a c-shaped cross section.

10. An expandable hardshell luggage article (10) comprising:

a first hard shell (12, 112);

a first frame member (16) that is secured to the first hard shell (12) including a first recess (54), a second frame member (18, 118) including a second recess (64);

a gusset (22, 122) extending between the first frame member (16) and the second frame member (18) to secure the second frame member (18, 118) to the first frame member (16) and to the the first hard shell (12, 112); and a bracing mechanism (70A) that in a first position holds the second frame member (18, 118) in secure engagement against the first frame member (16) such that the second frame member (18) is adjacent the first frame member (16), and in a second position secures the second frame member (18, 118) in spaced apart relation with respect to the first frame member (16) when the bracing mechanism (70A) is in the second position;

wherein an edge (40) of the gusset (22) is wrapped at least partially around a rod (50) and received in the recess (54) in the first frame member; and further comprising a first insert (56), wherein the first edge (40) of the gusset (22) and the first rod (50) are frictionally received in the first insert (56) that is frictionally received in the first recess (54).

11. The expandable hardshell luggage article of claim 10, wherein the gusset (22, 122) is secured directly to the first hard shell (12, 112).

12. The expandable hardshell luggage article of claim 10, wherein the second edge (60) of the gusset (22) is wrapped at least partially around a second rod (62) and the second edge (60) of the gusset (22) and the second rod (62) are received in the second recess (64) in the second frame member (18).

13. The expandable hardshell luggage article of claim 10, further comprising a third frame member (20) secured to a second hard shell (14), and wherein the third frame member (20) is connected to the second frame member (18).

14. The expandable hardshell luggage article of claim 13, wherein the third frame member (20) is secured to the second frame member (18) by at least one hinge (24).

15. The expandable hardshell luggage article of claim 10, the first frame member (16) and the second frame member (18) having a tongue and groove engagement.

16. The expandable hardshell luggage article of claim 10, further comprising a second insert (66), wherein the second edge (60) of the gusset (22) and the second rod (62) are frictionally received in the second insert (66) that is frictionally received in the second recess (64).

17. The expandable hardshell luggage article of claim 16, wherein the first insert (56) has a c-shaped cross section and the second insert (66) has a c-shaped cross section.

18. An expandable hardshell luggage article (10) comprising:

a first hard shell (12);

a first frame member (16) that is secured to the first hard shell (12) and that includes a first recess (54);

a second frame member (18) that includes a second recess (64);

a gusset (22) extending between the second frame member (18) and the first frame member (16) to secure the first frame member (16) to the second frame member (18);

wherein a first edge (40) of the gusset (22) is received in the first recess (64) in the first frame member (16), and a second edge (60) of the gusset (22) is received in the second recess (64) in the second frame member (16);

wherein the first edge (40) of the gusset (22) is wrapped at least partially around a first rod (50), and the first edge (40) of the gusset (22) and the first rod (50) are received in the first recess (54);

wherein the second edge (60) of the gusset (22) is wrapped at least partially around a second rod (62), and the second edge (60) of the gusset (22) and the second rod (62) are received in the second recess (64); and further comprising a first insert (56), wherein the first edge (40) of the gusset (22) and the first rod (50) are frictionally received in the first insert (56) that is frictionally received in the first recess (54).

19. The expandable hardshell luggage article of claim 18, further comprising a second insert (66), wherein the second edge (60) of the gusset (22) and the second rod (62) are frictionally received in the second insert (66) that is frictionally received in the second recess (64).

20. The expandable hardshell luggage article of claim 19, wherein the first insert (56) has a c-shaped cross section and the second insert (66) has a c-shaped cross section.

21. The expandable hardshell luggage article of claim 18, further comprising a third frame member (20), and wherein the third frame member (20) is secured to the second frame member (18) by at least one hinge (24).

22. The expandable hardshell luggage article of claim 18, wherein the first frame member (16) and the second frame member (18) include a tongue and groove engagement.

* * * * *